United States Patent [19]

Maas

[11] Patent Number: 4,932,172

[45] Date of Patent: Jun. 12, 1990

[54] PORTABLE ROOM DIVIDER

[76] Inventor: John C. Maas, 1387 Woodland La., Deerfield, Ill. 60015

[21] Appl. No.: 336,267

[22] Filed: Apr. 11, 1989

[51] Int. Cl.[5] ..... E04H 1/06

[52] U.S. Cl. ..... 52/71; 52/239; 312/297

[58] Field of Search ..... 52/239, 71, 32, 29; 312/297

[56] References Cited

U.S. PATENT DOCUMENTS

| | | | |
|---|---|---|---|
| 756,091 | 3/1904 | Altick | 312/297 |
| 1,410,225 | 3/1922 | Seaman | 52/239 |
| 1,731,327 | 10/1929 | Terrisse | 52/71 |
| 2,162,523 | 6/1939 | Blood et al. | 52/71 |
| 3,330,611 | 7/1967 | Heifetz | 312/297 |
| 3,387,413 | 6/1968 | Huey | 52/71 |
| 3,402,515 | 9/1968 | Rainaut | 52/71 |
| 3,534,512 | 10/1970 | Ballas | 52/71 |
| 3,629,982 | 12/1971 | Ballay | 52/71 |
| 3,866,365 | 2/1975 | Honigman . | |
| 4,161,850 | 7/1979 | Peterson et al. . | |
| 4,192,106 | 3/1980 | Hell . | |
| 4,569,163 | 2/1986 | Long . | |

*Primary Examiner*—Michael Safavi

*Attorney, Agent, or Firm*—Quarles & Brady

[57] ABSTRACT

A combination cabinet-room divider includes at least one storage compartment which contains a plurality of folded wall panels. The panels can be removed and unfolded to form a wall that is anchored at one end to the cabinet. In a preferred embodiment, the cabinet-room divider has two storage compartments and two sets of wall panels.

4 Claims, 5 Drawing Sheets

FIG. 4
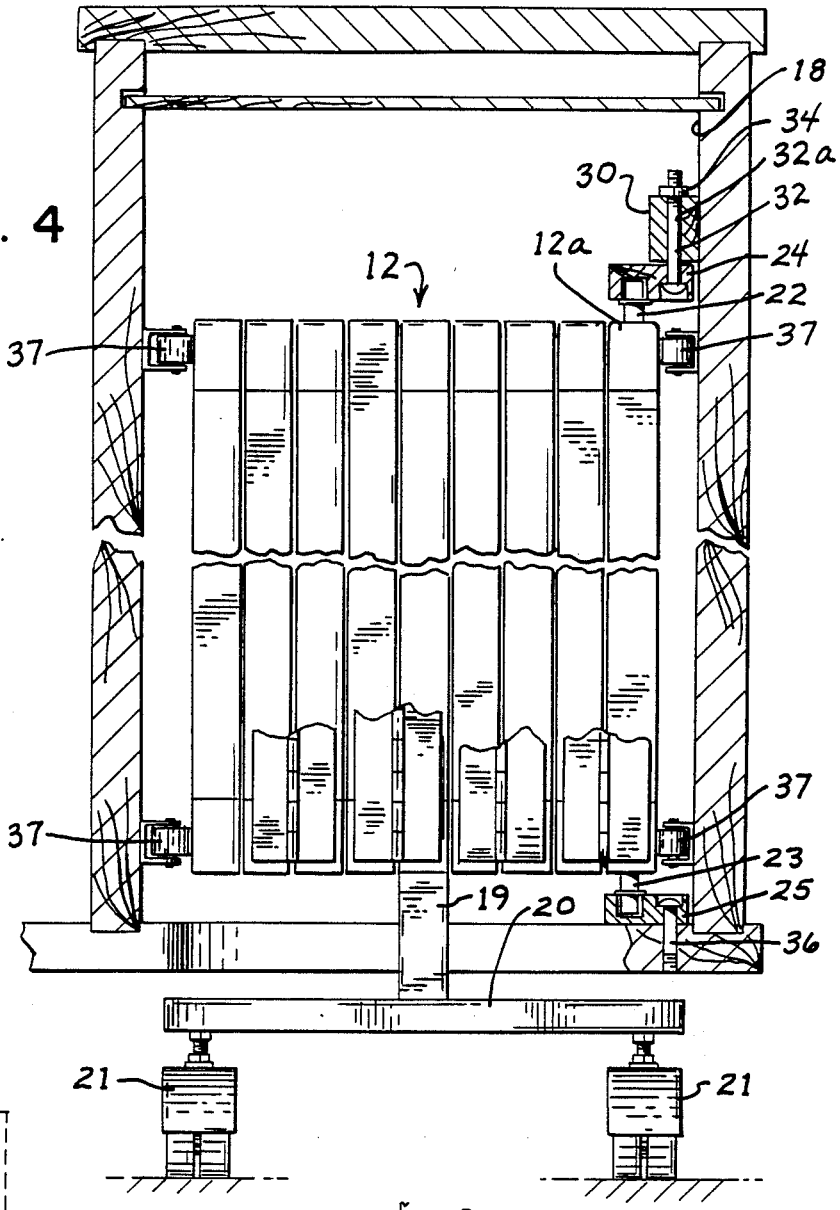
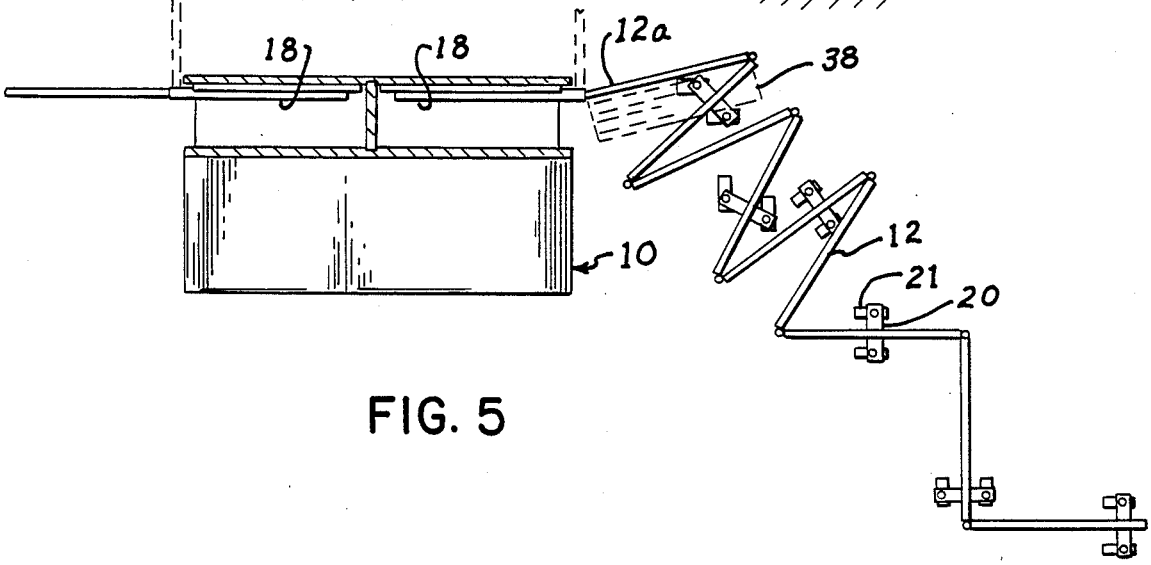
FIG. 5

PORTABLE ROOM DIVIDER

FIELD OF THE INVENTION

The present invention relates generally to room dividers, more particularly, it relates to a portable combination cabinet-room divider.

BACKGROUND OF THE INVENTION

There are times that it is desired to divide large areas, such as rooms or halls, into smaller more private areas. One method of doing this is by the use of movable wall panels which are suspended from and move on tracks attached to the ceiling and/or floor. This method is relatively expensive and it is inflexible.

Another method of dividing large areas into smaller private areas is to use movable free standing wall units. This method is relatively inexpensive and it permits the formation of areas of a wide variety of shapes, but the free standing wall units present storage and handling problems.

There is a need for portable apparatus for dividing large areas into a wide variety of different shaped smaller and more private areas which does not present storage and handling problems.

BRIEF SUMMARY OF THE INVENTION

It is an object of the present invention to disclose an inexpensive, apparatus for dividing large areas into smaller private areas.

It is a further object to disclose such an apparatus which does not present the storage and handling problems of prior art free standing wall units.

The apparatus of the present invention comprises a portable cabinet with a hollow interior which contains a plurality of folded wall panels which can be removed and unfolded to form a wall. One end of one of the wall panels is anchored to the cabinet and the other end is attached by a hinge to a second wall panel. Additional wall panels are hingedly connected together in a similar manner to form a wall of the desired length.

In one preferred embodiment the cabinet is mounted on casters and in another it is adapted to be hung on a wall. In both preferred embodiments a storage compartment in the hollow interior of the cabinet is closed by a door that can be opened to permit the removal and return of the folded wall panels.

It will be apparent to those skilled in the art from the description that follows that the aforementioned and other objects can be achieved by the apparatus of the present invention.

BRIEF DESCRIPTION OF THE DRAWINGS

In the drawings:

FIG. 4 is an enlarged sectional view taken along lines 4—4 in FIG. 3;

FIG. 5 is a partial top view, partly in section, of the embodiment of FIG. 2;

DESCRIPTION OF A PREFERRED EMBODIMENT

Figure 2:
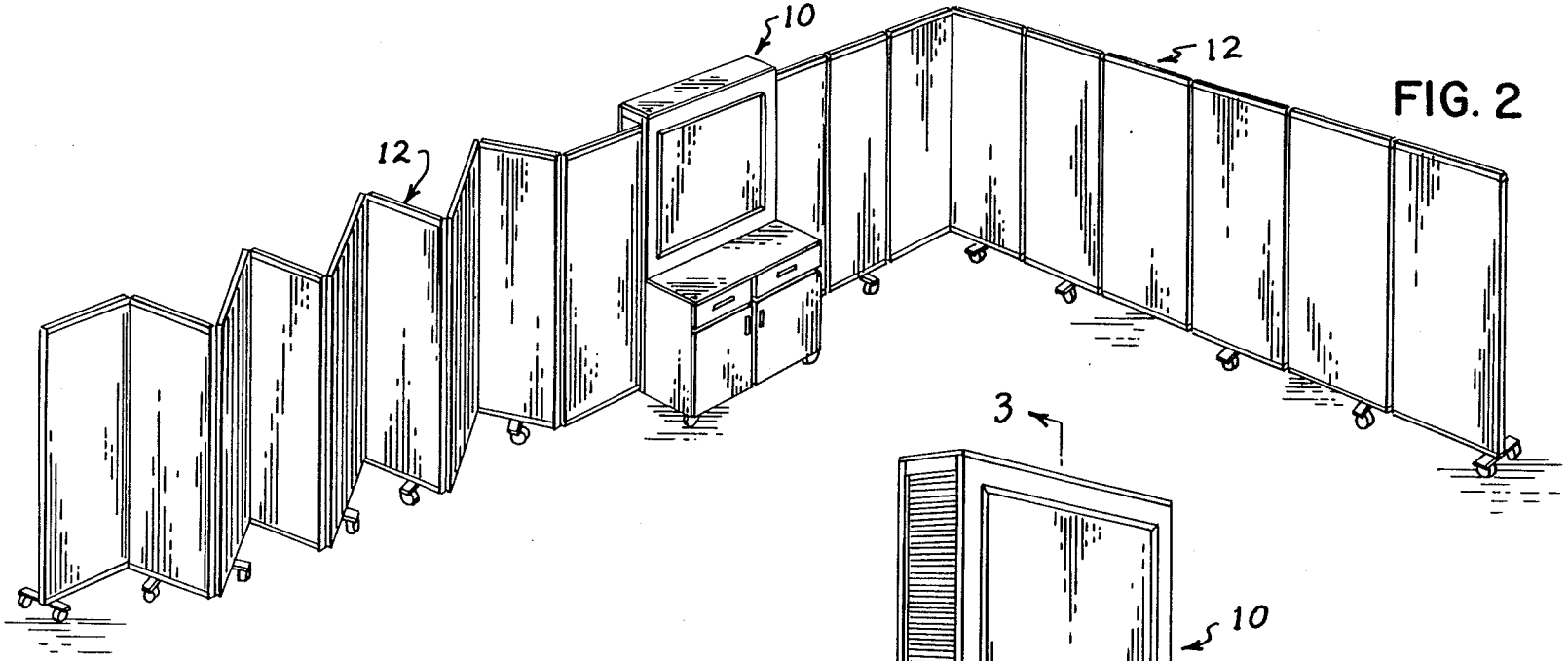
FIG. 2 is a perspective view of the cabinet of FIG. 1 with the open doors and the wall panels unfolded.
Figure 1:
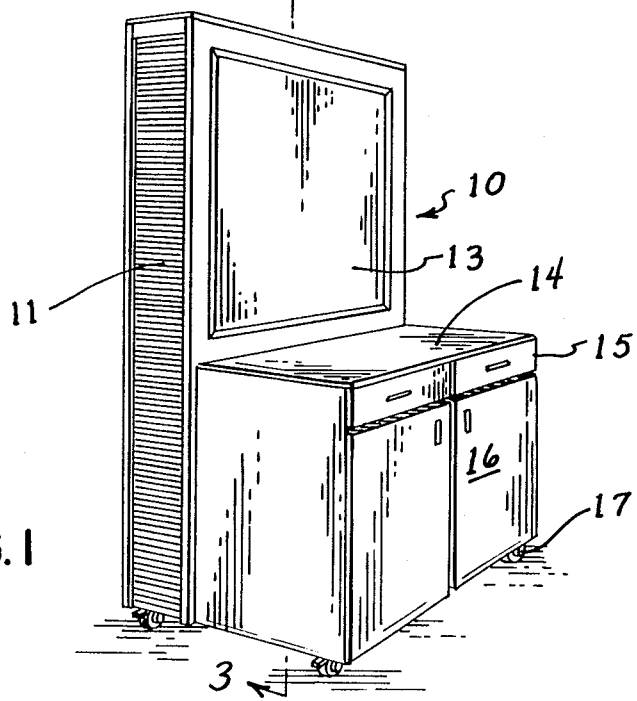
FIG. 1 is a perspective view of the embodiment of the cabinet of the present invention having casters.

In the drawings FIGS. 1 and 2 show a cabinet - room divider 10 of the present invention. In FIG. 1 the cabinet-room divider 10 is shown prior to use as a room-divider and in FIG. 2 it is shown in use with the doors 11 open and the wall panels 12, which are normally stored therein, unfolded. In FIG. 1 only one of the doors 11 can be seen, but there are two such doors one at each end of the cabinet-room divider 10.

Still referring to FIGS. 1 and 2, it can be seen that the cabinet-room divider 10 has both a vertical work surface 13 and a horizontal work surface 14. It also has storage drawers 15 and doors 16 that close off parts of the cabinet interior below the horizontal work surface 14. The cabinet-room divider 10 is mounted on all-directional casters 17 so it is portable and can be easily moved from one location to another.

Figure 3:
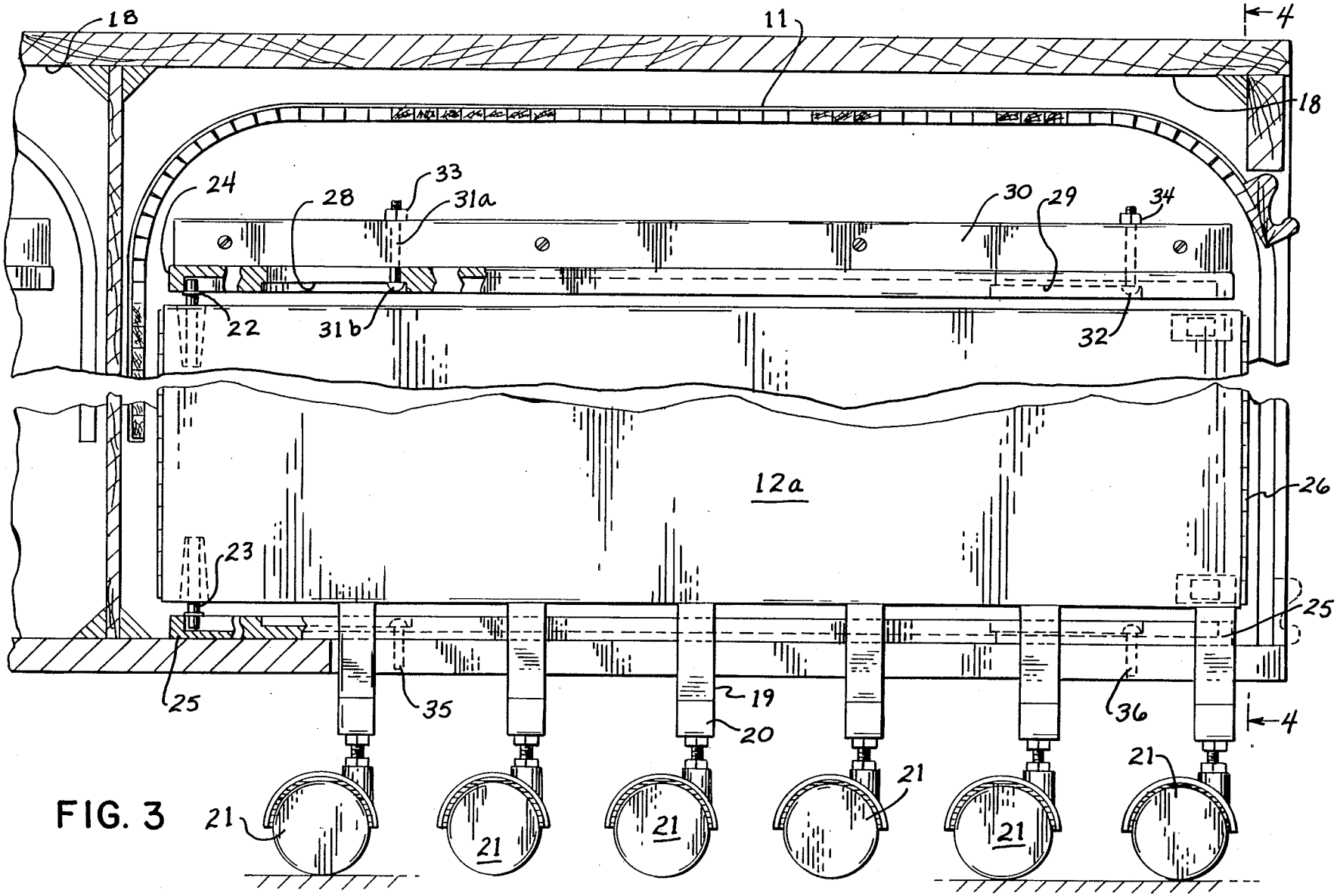
FIG. 3 is an enlarged, sectional partial view of one of the storage compartments of the cabinet of FIG. 1 taken along lines 3—3.
Figure 6:
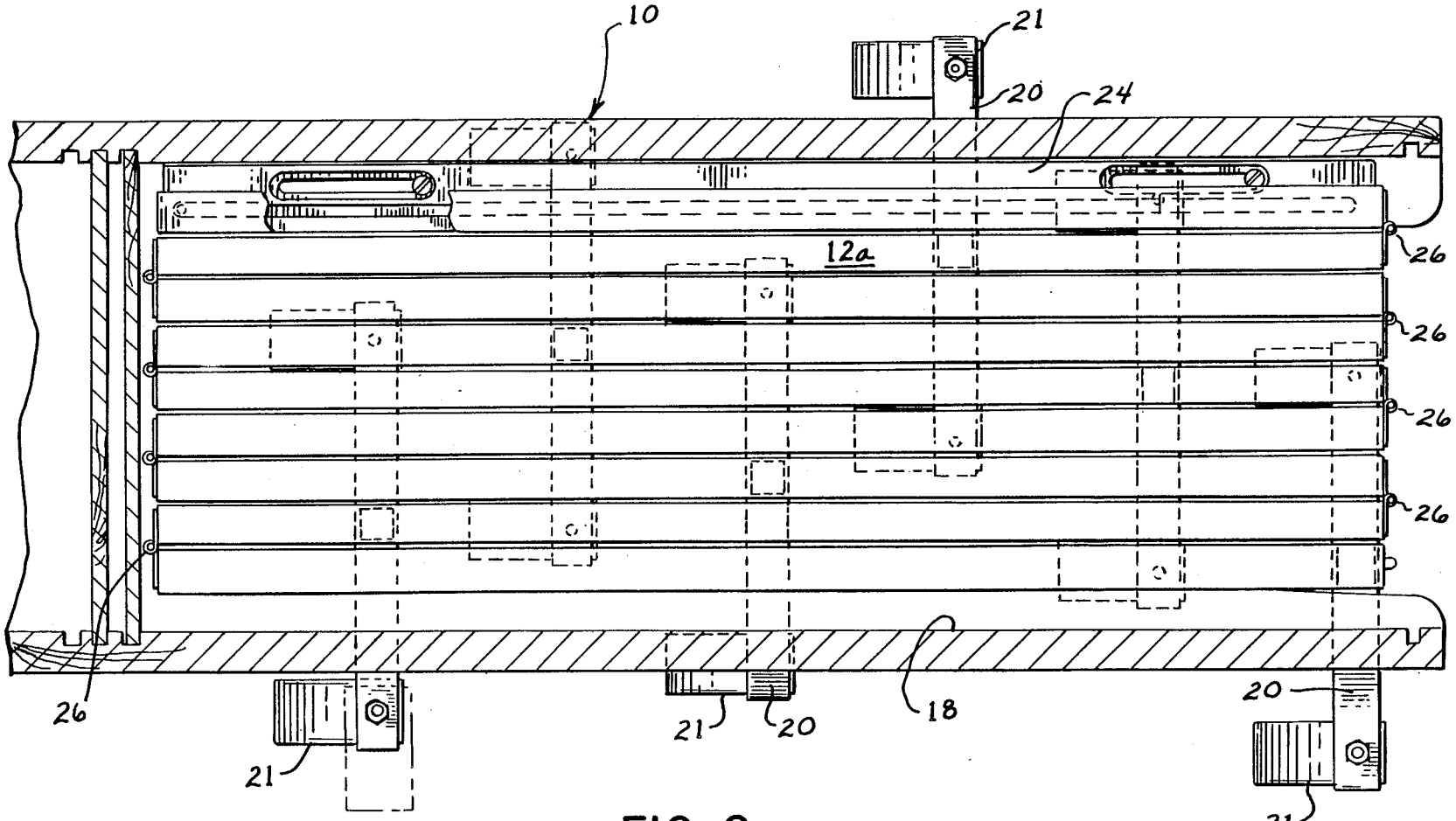
FIG. 6 is a top view of the storage compartment of FIG. 3.

In FIGS. 3, 4 and 6, the cabinet-room divider 10 is shown with wall panels 12 stored within one of two panel storage compartments 18 in the hollow interior of the cabinet - room divider 10. As seen therein, selected wall panels 12 are each provided at the bottom with a leg 19 with a foot 20 having two pair of spaced-apart floor engaging casters 21.

Still referring to FIGS. 3 and 4, it can be seen that there are anchor pins 22 and 23 which are mounted on the top and bottom, respectively of the inside end of the panel 12*a*. The pins 22 and 23 cooperate with top and bottom slides, 24 and 25, respectively, to permit the panel 12*a* to be slid out of the compartment 18 and to prevent panel 12*a* from becoming detached from the cabinet 10 when the panels 12 are removed from storage compartment 18 and unfolded as seen in FIG. 5.

Returning to FIG. 6, each of the wall panels 12 is seen to be connected to the immediately adjacent panels by hinges 26 so that they can be readily unfolded or folded to form integral walls as seen in FIGS. 2 and 5, respectively.

Figure 7:
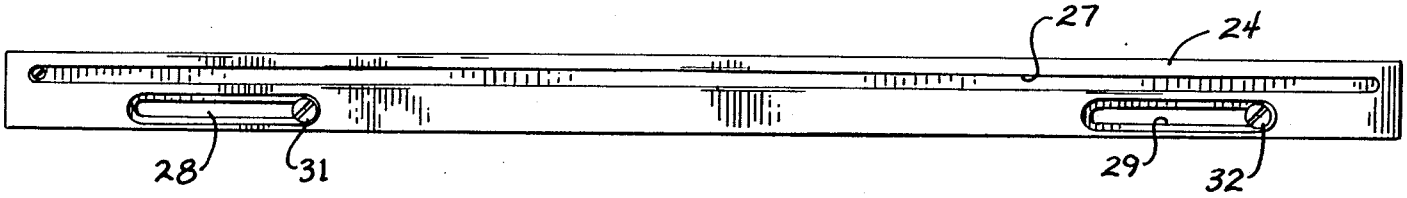
FIGS. 7 to 9 are views showing the mechanism which anchors a panel to the cabinet.
Figure 8:
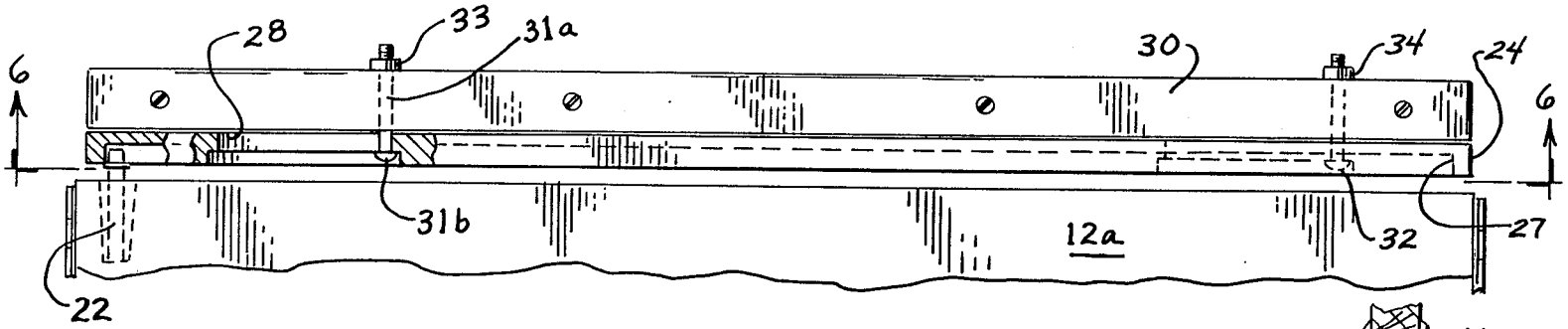
Figure 9:
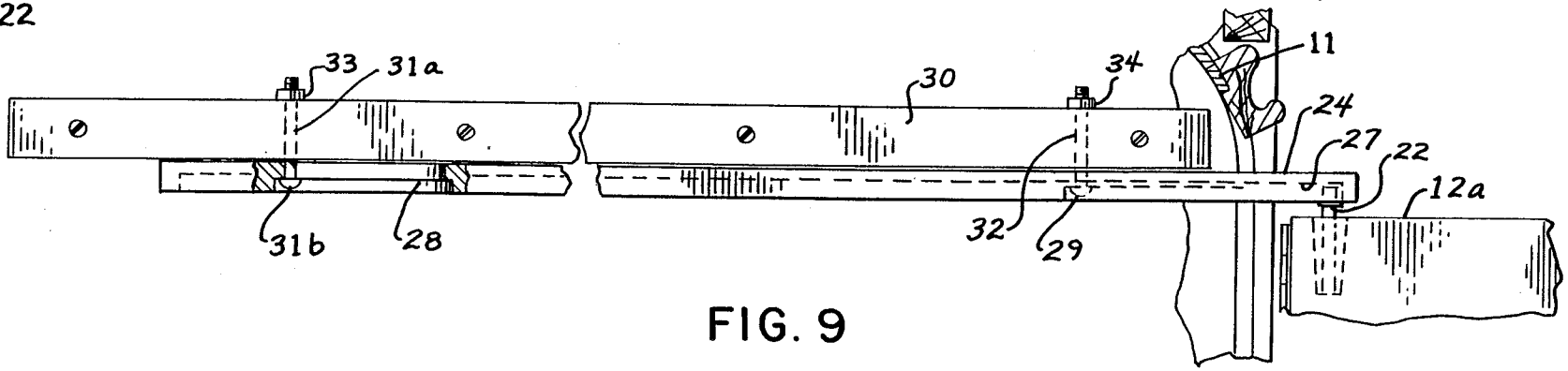

In FIGS. 7, 8 and 9 the top slide 24 and its relationship with the panel 12*a*, the pin 22 and the compartment 18 is illustrated. As seen best in FIG. 7, the slide 24 is an elongated member, preferably of a self-lubricating plastic, which has a track 27 for the pin 22 and a slot 28, 29 at each end.

As seen in FIGS. 3, 4 and 8, the slide 24 is secured to a bracket 30 on one wall of the compartment 18 by a pair of bolts 31, 32 and nuts 33, 34. The bolt 31 has a shank 31*a* which extends through and is narrower than the slot 28 and an enlarged head 31*b* which is wider than the slot 28. The other end of the slide 24 is secured to the bracket 30 in a similar manner with the bolt 32 and nut 34. When the panel 12*a* is stored as seen in FIG. 8 the bolts 31, 32 are at the far right end of the slots 28 and 29 and when the panel 12*a* is fully extended (as seen in FIG. 9) the bolts 31, 32 are at the innermost other end of the slots 28 and 29 and the pin 22 is at the outermost end of the track 27. The bottom slide 25 seen in FIG. 3 is identical to top slide 24 and it is attached to the bottom of the compartment 18 with bolts 35, 36.

Finally, in FIG. 4, it can be seen that the wall panels 12 are stabilized in the compartment 18 by rollers 37 which are mounted on the side walls of the compartment 18.

In use the cabinet-room divider 10 with the folding wall panels 12 stored and the doors 11 closed as seen in FIG. 1 can be readily moved into an area to be divided. The cabinet - room divider 10 is positioned where desired to divide the area into one or more predetermined private areas. The casters 17 are then locked in place with caster brakes (not shown). The doors 11 are raised, and the hinged, folded wall panels 12 removed from the storage compartment 18 as a stack 38 as seen in dotted lines in FIG. 5. The movement of the panels 12 from the storage compartment 18 is controlled and stopped by the cooperation of panel 12*a*, pins 22, 23 and the slides 24, 25. The withdrawal of the panels 12 as a stack 38 is facilitated by the casters 21 on the feet 20 of the selected wall panels 12 and the rollers 37. The wall panels 12 can be then unfolded as seen on the right in FIG. 5 and arranged to form a wall as seen in FIG. 2. If desired, the casters 21 also can be provided with caster brakes to help immobilize the thus formed wall.

The same procedure can be used to remove and assemble a second wall using the wall panels stored in the other panel storage compartment of the cabinet interior.

When it is desired to disassemble the walls and store the wall panels 12 in the storage compartment 18, the caster brakes, if any, on the casters 21 are unlocked and the hinged panels 12 are folded to form the stack 38 as seen in FIG. 5. The storage of the stack 38 of wall panels in the storage compartment 18 is facilitated by the cooperation of the pins 22, 23, the slides 24 and 25 and the rollers 37.

It will be apparent to those skilled in the art from the foregoing description and the drawings that the present invention provides a very convenient, inexpensive and flexible means for dividing large areas into smaller more private areas. As seen in FIG. 2, the walls that are formed can be straight, angular or partially folded. The walls can be the width of a single wall panel or any multiple thereof and within limits they can extend in any direction.

It also will be apparent to those skilled in the art that a number of changes and modifications can be made without departing from the spirit and scope of the invention. For example, if desired the cabinet-room divider can be adapted to hang upon a wall or provided as a doubled cabinet with horizontal work surfaces on each side of the panel storage compartment. In addition, the casters and legs may take forms other than those shown and described. Therefore, it is intended that the invention not be limited except by the claims.

I claim:

1. A portable cabinet-room divider comprising:

(a) a cabinet having a work surface;

(b) an enclosed panel storage compartment positioned behind said work surface;

(c) a plurality of hinged wall panels folded and stored in said compartment, some of said panels having supporting caster means including a pair of spaced apart casters supported by a foot which when the panels are unfolded have the foot perpendicular to the panel and the casters parallel to the panel upon which they are mounted, said compartment being open at the bottom to accommodate said caster means;

(d) roller means in said compartment to provide internal lateral support for the panels in the compartment to maintain them in a folded condition without touching internal walls of said compartment; and (e) retraction and extension means connecting said cabinet to a first of said panels at one side, the other side of said first panel being hingedly connected to a second of said panels, said extension and retraction means permitting said panels to be removed as a stack from said compartment and unfolded to form a wall anchored at one end by the cabinet.

2. A portable cabinet-room divider comprising:

(a) a cabinet having a work surface;

(b) an enclosed panel storage compartment positioned behind said work surface;

(c) a plurality of hinged wall panels folded and stored in said compartment, some of said panels having supporting caster means, said compartment being open at the bottom to accommodate said caster means;

(d) roller means in said compartment to provide internal lateral support for the panels in the compartment to maintain them in a folded condition without touching internal walls of said compartment; and (e) retraction and extension means connecting said cabinet to a first of said panels at one side, the other side of said first panel being hingedly connected to a second of said panels, said extension and retraction means including a self lubricating plastic bar which is mounted adjacent one end to the cabinet permitting said panels to be removed as a stack from said compartment and unfolded to form a wall anchored at one end by the cabinet.

3. A portable cabinet-room divider comprising:

(a) a cabinet having a work surface;

(b) at least one internal panel storage compartment in said cabinet, said compartment being behind said work surface, and open at the bottom;

(c) a plurality of hinged wall panels in said compartment with some of the panels having supporting caster means including at least two spaced apart casters mounted on a foot, said compartment providing internal lateral support for the panels in the compartment to maintain them in a folded condition;

(d) means anchoring a first of said panels at one side to the cabinet and a second of said panels being hingedly connected to the other side of the first panel so that said panels can be removed from the compartment to form a wall anchored at one end by the cabinet with the work surface located inside the wall; and (e) retaining means for retaining said panels in said compartment.

4. A portable cabinet-room divider comprising:

(a) a cabinet having a work surface;

(b) at least one internal panel storage compartment in said cabinet, said compartment being behind said work surface, and open at the bottom;

(c) a plurality of hinged wall panels in said compartment with some of the panels having supporting caster means, said compartment providing internal lateral support for the panels in the compartment to maintain them in a folded condition;

(d) means anchoring a first of said panels at one side to the cabinet and a second of said panels being hingedly connected to the other side of the first panel so that said panels can be removed from the compartment to form a wall anchored at one end by the cabinet with the work surface located inside the wall; and (e) an overhead door for retaining said panels in said compartment.

* * * * *